United States Patent [19]

Jackson et al.

[11] Patent Number: 4,621,863

[45] Date of Patent: Nov. 11, 1986

[54] RECLINING CHAIR HAVING A DETACHABLE LEG REST

[75] Inventors: W. Ronald Jackson, Cleveland, Tenn.; Albert J. Kraus; Wesley E. Lerdon, both of Columbus, Ohio

[73] Assignee: Cleveland Chair Company, Cleveland, Tenn.

[21] Appl. No.: 819,582

[22] Filed: Jan. 17, 1986

[51] Int. Cl.[4] ..... A47C 1/035; A47C 7/52

[52] U.S. Cl. ..... 297/85; 297/68; 297/330; 297/423; 297/436; 297/440

[58] Field of Search ..... 297/68, 84, 85, 330, 297/423, 428, 433, 434, 436, 440

[56] References Cited

U.S. PATENT DOCUMENTS 3,596,982 8/1971 Grams ..... 297/330 X 3,804,460 4/1974 Leffler ..... 297/330

4,365,836 12/1982 Jackson et al. ..... 297/85

4,508,387 4/1985 Gilbert et al. ..... 297/433 X

*Primary Examiner*—Francis K. Zugel

*Assistant Examiner*—Peter R. Brown

*Attorney, Agent, or Firm*—Gottlieb, Rackman & Reisman

[57] ABSTRACT

A reclining chair having a stationary frame, a moveable seat/back occupant support, and a leg rest. The chair includes quadrilateral linkages and extender linkages on each side in order that the seat/back occupant support may be tilted backwards while the leg rest is extended upward and outward. The leg rest of the chair is detachably connected to the pair of extender linkages by use of studs on the leg rest and mounting holes on the tip of the extender linkages. This permits the leg rest to pop off if a person interferes with the leg rest as it is being retracted, thus avoiding serious injury.

5 Claims, 7 Drawing Figures

FIG. 4
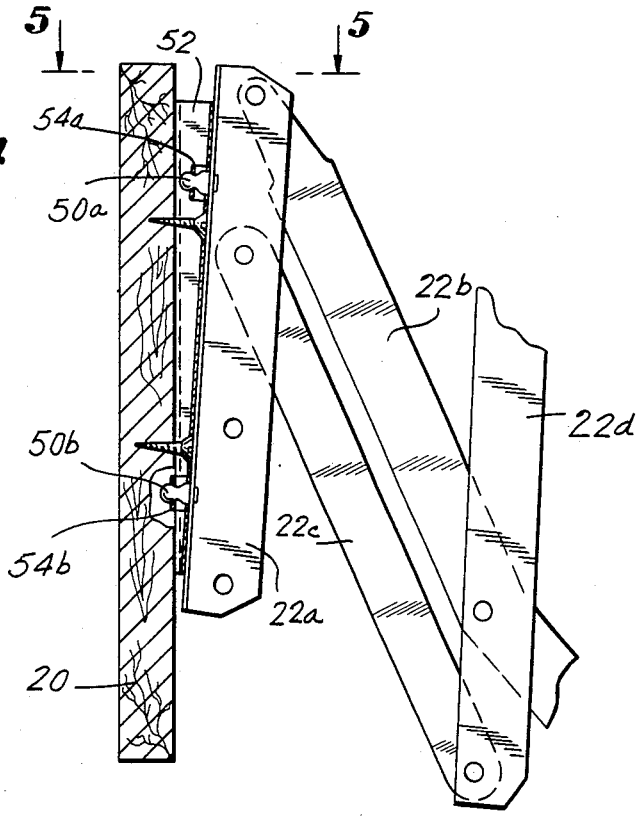
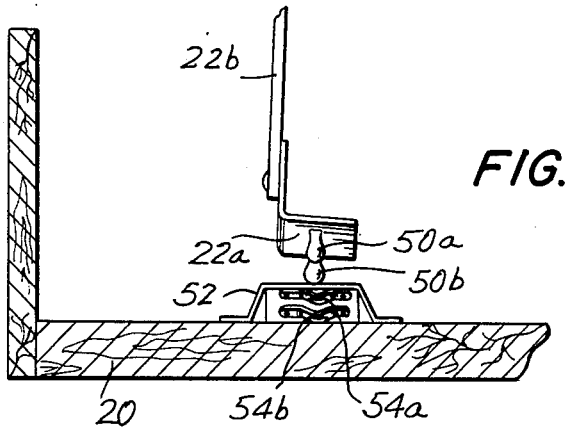
FIG. 5

RECLINING CHAIR HAVING A DETACHABLE LEG REST

BACKGROUND OF THE INVENTION

This invention relates to reclining chairs, and more particularly to a reclining chair having a detachable leg rest.

A reclining chair generally takes on one of two forms. In a two-way chair, the seat and back are rigidly connected. Consequently, when moving from an upright position to a fully reclined position, the leg rest rises and the seat/back tilts backward. In a three-way chair, the back is pivoted to the seat. Thus, in moving from an upright position to a fully reclined position, there is an additional tilt in the back relative to the seat.

A particularly advantageous reclining chair is one that is motorized. In prior art U.S. Pat. No. 4,365,836, a motorized reclining chair is disclosed which is controlled by a single reversible motor. The chair permits leg rest motion to take place without seat/back motion until the leg rest is raised to an intermediate position; three-way operation can be provided at minimal cost; and when moving to the fully reclined position, the entire seat rises, with the front edge rising more than the rear edge. In this chair, a motive force is provided by an upwardly thrusting shaft controlled by the motor.

Although the chair described in U.S. Pat. No. 4,365,836 solves a number of problems in the industry, it nevertheless leaves one problem unsolved. Since the leg rest of a reclining chair—motorized or manual—is permanently fixed to an extender linkage, some consumers could fear that the chair poses safety problems. If a child, for example, places an arm behind the leg rest, between the leg rest and the front of the chair, the child may be injured if the chair is accidently moved from the reclined position to the upright position. Pets could pose a similar problem. The problem is more apparent with a motorized chair; the consuming public could be afraid of what an "unstoppable" motor may do.

SUMMARY OF THE INVENTION

Generally speaking, in the preferred embodiment of the invention, the reclining chair includes a stationary frame, a movable seat/back occupant support, and a leg rest. By the use of a pair of quadrilateral linkages, one on each side of the chair, and a pair of leg rest extender linkages, one also on each side of the chair, the seat/back occupant support may be tilted backwards while at the same time the leg rest may be extended upward and outward, thereby enabling the chair to be placed into a reclining position. The leg rest is detachably connected at each end to one of the leg rest extender linkages. If the chair is moving to the upright position, with the leg rest moving toward the body, and a child or pet gets in the way, the leg rest simply pops off in order to prevent an injury.

In the preferred embodiment, the reclining chair is motorized and movement is controlled by a single reversible motor. Motive force is derived by a motor-driven shaft underneath the seat which pushes against the leg rest extender mechanism.

Accordingly, it is an object of the invention to provide an improved reclining chair.

Another object of the invention is to provide an improved reclining chair having a detachable, pop-off, leg rest.

Still another object of the invention is to provide an improved reclining chair which poses no hazards.

BRIEF DESCRIPTION OF DRAWINGS

For a fuller understanding of the invention, reference is made to the following description taken in connection with the accompanying drawings, in which:

FIG. 4 is a sectional view of the leg rest and a leg rest extender linkage after attachment;

FIG. 5 is a sectional view taken along line 5—5 of FIG. 4;

DETAILED DESCRIPTION OF PREFERRED EMBODIMENT

Figure 1:
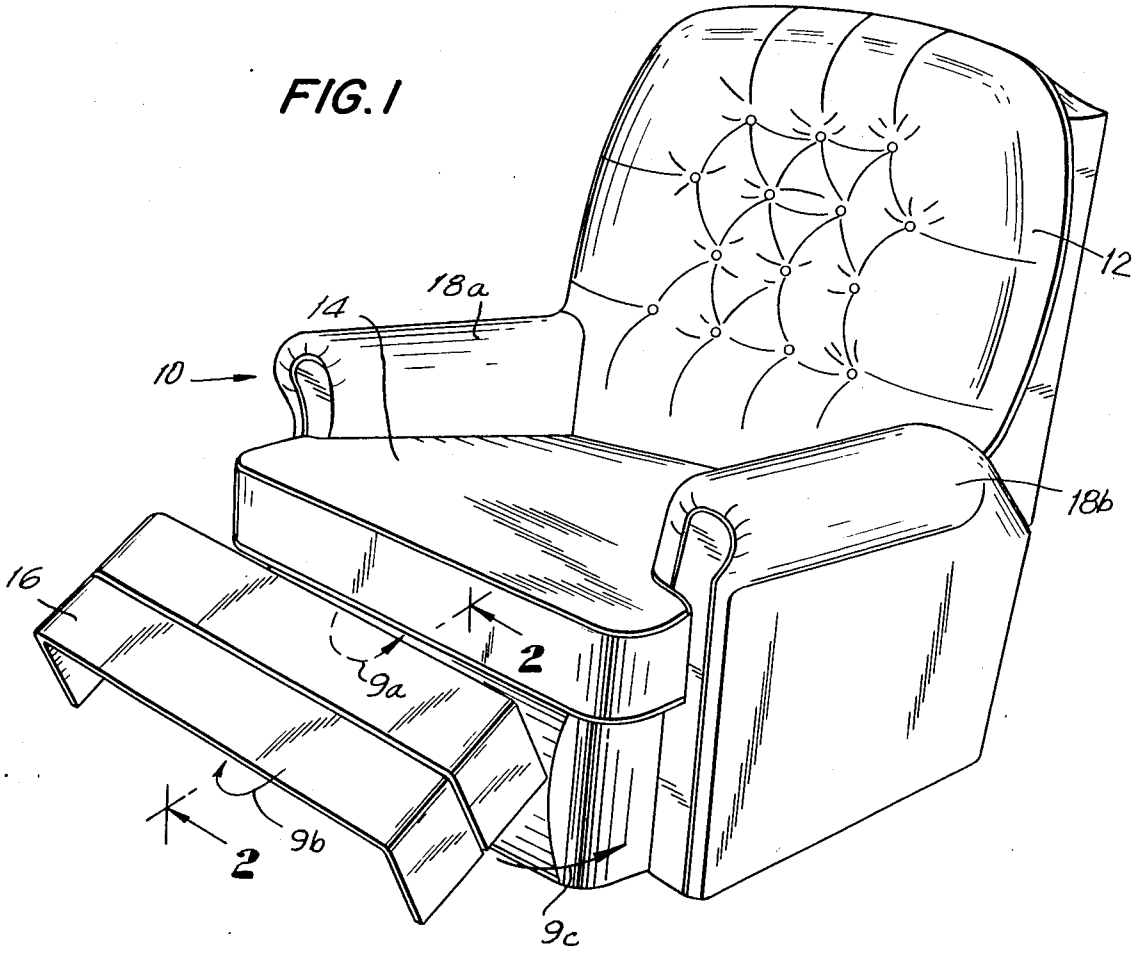
FIG. 1 is a perspective view of a reclining chair constructed in accordance with the invention in which the leg rest has been raised to an intermediate position.

Reference is made first to FIG. 1 which illustrates a reclining chair 10 of the invention. The chair includes a back 12, seat cushion 14 and arms 18*a* and 18*b*, as shown. Chair 10 further includes a leg rest 16 which has been raised to an intermediate position.

Figure 2:
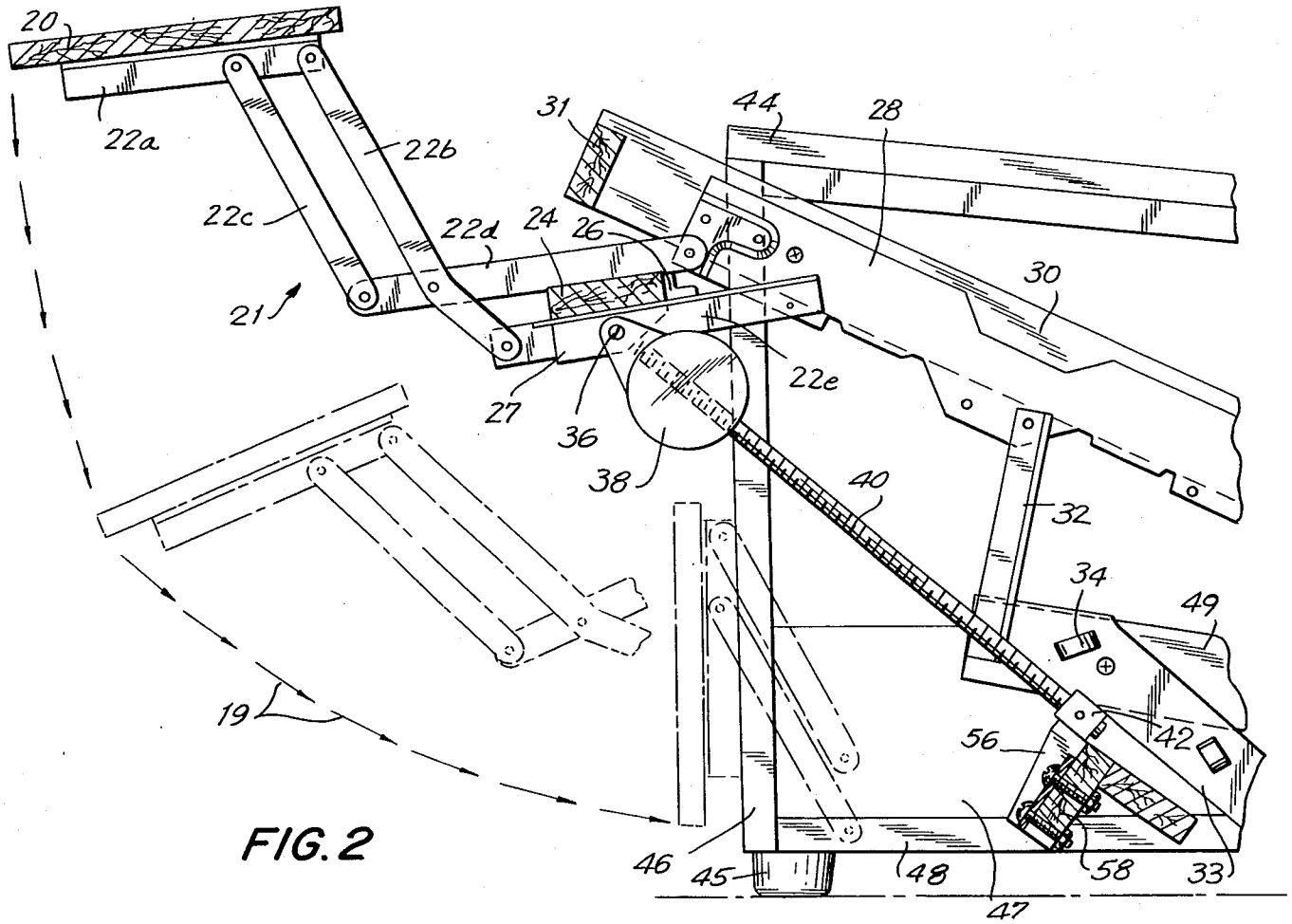
FIG. 2 is a sectional view taken through line 2—2 of FIG. 1, but with the chair in the fully extended position.

FIG. 2 depicts various wood frames involved in the construction of chair 10, as well as some of the linkage mechanisms. (A comprehensive description will be found in U.S. Pat. No. 4,365,836 which is hereby incorporated by reference.) Chair 10 has two main wood frames, one of which is stationary and one of which serves as a seat/back support for a user (not fully shown). The stationary frame includes an arm rest 44 on each side, a bottom section 48 and substantially vertical side 46. A pair of legs 45 are provided on each side, as is standard in chair construction. On each side of the frame there is also a panel 47.

On each side of the chair there is mounted a quadrilateral linkage mechanism. Each of these primary linkages includes links 28, 32, and 33 (the fourth is not shown). Link 33 is fixed to board 49, which in turn is attached to panel 47. The two links 33, one on each side of the chair, are symmetrical and include a stop 34. (The stop limits downward movement—see FIG. 3.) Link 28 is attached to a side section 30 of the seat/back frame as shown. A cross-frame member 31 is provided for connecting the two side sections 30. Thus, first and second links of the linkage mechanism are connected respectively to a stationary frame and a movable seat/back occupant support. These two links are connected to each other on each side of the chair by the two remaining links (one of which is link 32) of the mechanism.

As further shown in FIG. 2, a conventional leg rest extender linkage 21 is connected between link 28 and a leg rest board 20 on each side of the chair. (Leg rest 16 of FIG. 1 is mounted on this board.) Extender linkage 21 includes five links 22*a*–22*e*, with link 22*a* being screwed to one end of leg rest board 20, and links 22*d* and 22*e* being pivoted to link 28 of the quadrilateral linkage mechanism. A small angle bracket 26 is secured to link 22*e*. When extender linkage 21 is extended in order to raise the leg rest, bracket 26 will eventually bear against link 22*d* so that there is no longer any motion of the links. A support board 24 is also provided and is connected between pairs of links 22*e*, as shown.

A motor/shaft arrangement is also depicted in FIG. 2. Bracket 27 is secured to board 24 in the center of the chair. A pivot 36 in the bracket is used to mount the clevis extension of a motor/gear box 38. Gear box 38 serves to transmit a driving force from the motor to a shaft 40, the shaft having the form of a long lead screw. Shaft 40 passes through a nylon swivel nut 42, the two sides of which are pivoted at 62 to a bracket 56. Bracket 56, in turn, is attached by a pair of screws to a board 58. For a further description of the motor/shaft arrangement, reference is made once again to U.S. Pat. No. 4,365,836.

Arrows 9*a*, 9*b* and 9*c* in FIG. 1 illustrate the "pinch" regions where a pet or child may get hurt as the leg rest retracts and the chair returns to the upright position. Arrows 19 in FIG. 2 depict the movements of the leg rest and extender linkages during this process, three stages being shown (two of them in phantom).

Figures 3, 6, 7:
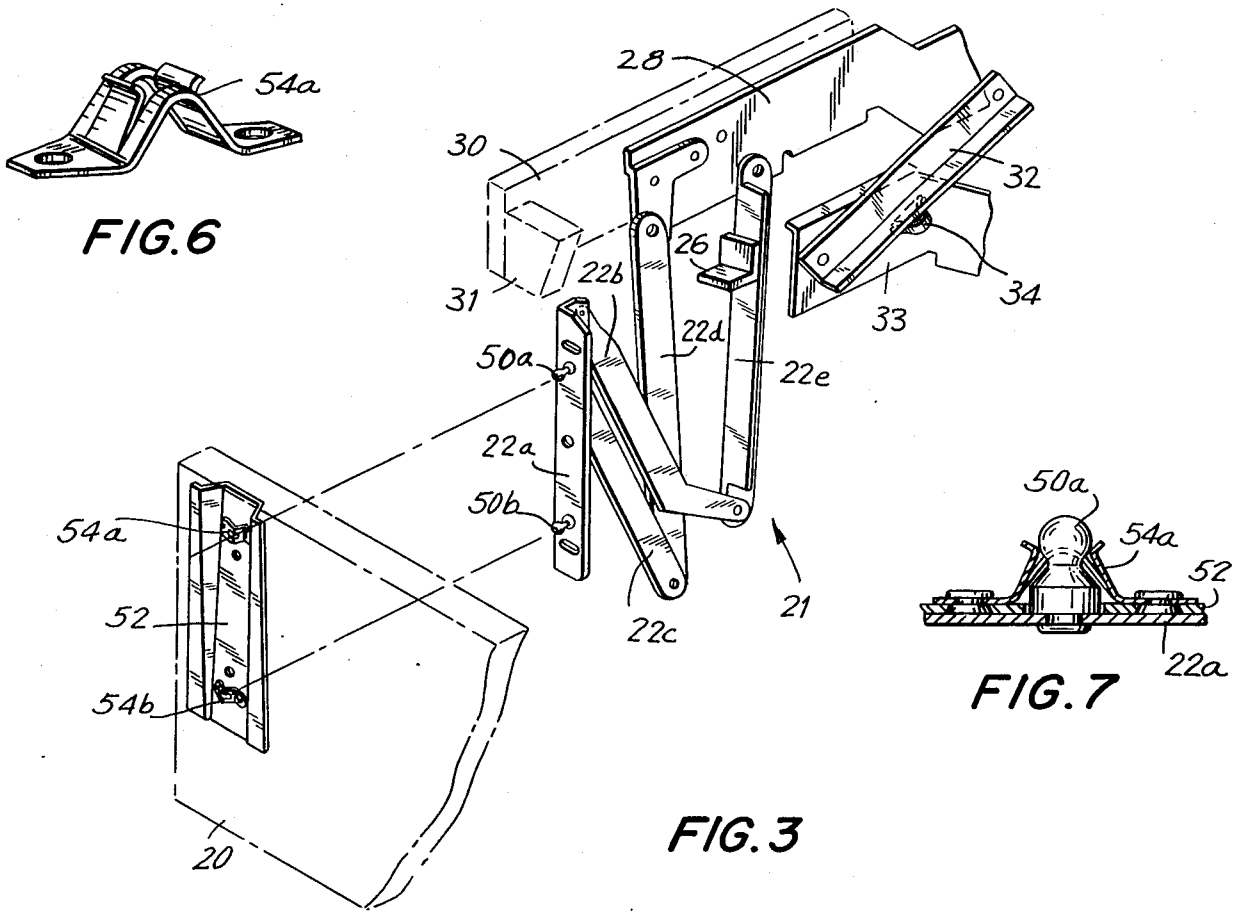
FIG. 3 is a sectional view of one side of the leg rest and the associated leg rest extender linkage before attachment.
FIG. 6 is a perspective view of a stud receiver.
FIG. 7 is a sectional view of a stud-receiver assembly.

Reference is now made to FIGS. 3, 4 and 5 which illustrate the detachable leg rest of the invention. Leg rest board 20 is formed with a pair of receiver panels 52 on either end of the inside surface. Each receiver panel 52 includes a pair of stud receivers 54*a* and 54*b* (See FIG. 6) for receiving ball studs 50*a* and 50*b*, respectively, of link 22*a* of leg rest extender linkage 21. The stud receivers and ball studs mate with each other. (See FIG. 7). In order to attach leg rest board 20 to the pair of leg rest extender linkages 21, it is necessary to visually align stud receivers 54*a* and 54*b* of panel 52 with ball studs 50*a* and 50*b*. Once all four holes are aligned, the top side of leg rest board 20 should be lightly struck in order to securely fasten leg rest board 20 to the chair. Similarly, leg rest board 20 may be disattached from the leg rest extender linkages 21 by simply applying a small removing force to leg rest board 20 in order that ball studs 50*a* and 50*b* disengage from stud receivers 54*a* and 54*b*. The separation force required is less than that which would normally cause serious injury to a person who gets in the way of a retracting leg rest. In such a case, the leg rest simply pops off. In the illustrative embodiment of this invention, ball-stud Tinnerman brand fasteners of the Eaton Corporation are used. In various chairs, the release force for each of four fasteners used was selected to be between 18 and 30 pounds.

Although the disengaging leg rest has been described in connection with a motorized reclining chair, the invention may be used even in non-motorized reclining chairs.

Although the invention has been described with reference to a particular embodiment it is to be understood that this embodiment is merely illustrative of the application of the principles of the invention. Numerous modifications may be made therein and other arrangements may be devised without departing from the spirit and scope of the invention.

I claim:

1. A reclining chair comprising a stationary frame; a movable seat/back occupant support; a leg rest; means for tilting said seat/back occupant support backwards and for extending said leg rest upward and outward, said tilting and extending means including a pair of leg rest extender linkage means, one on each side of the chair; first mating means at the end of each of said leg rest extender linkage means; and second mating means on each end of said leg rest each of which detachably secures said leg rest to a respective one of said first mating means; the force required to disengage said first and second means from each other being less than that which would normally cause serious injury to a person who interferes with retraction of said leg rest.

2. The reclining chair of claim 1 wherein one of said mating means includes a plurality of studs and the other of said mating means includes a plurality of mounting holes, said studs and mounting holes being aligned so as to detachably connect said leg rest extender linkage means to said leg rest.

3. The reclining chair of claim 2 wherein said extending and tilting means includes a pair of quadrilateral linkages, one on each side of the chair, each of said quadrilateral linkages having a first link rigidly secured to said stationary frame, a second link rigidly secured to said moveable seat/back occupant support, and third and fourth links both connected between said first and second links, each of said leg rest extender linkage means being connected to a respective one of said quadrilateral linkages, and motor means for actuating both of said leg rest extender linkage means to move the leg rest between upright and reclining positions.

4. The reclining chair of claim 1 wherein said extending and tilting means includes a pair of quadrilateral linkages, one on each side of the chair, each of said quadrilateral linkages having a first link rigidly secured to said stationary frame, a second link rigidly secured to said moveable seat/back occupant support, and third and fourth links both connected between said first and second links, each of said leg rest extender linkage means being connected to a respective one of said quadrilateral linkages, and motor means for actuating both of said leg rest extender linkage means to move the leg rest between upright and reclining positions.

5. The reclining chair of claim 1, further including a motor means for actuating said leg rest extender linkage means to move the leg rest between upright and reclining positions.

* * * * *